US008297748B2

(12) United States Patent
Chiwata

(10) Patent No.: US 8,297,748 B2
(45) Date of Patent: Oct. 30, 2012

(54) PRINTED MATTER SEASONING APPARATUS AND METHOD, AND INKJET RECORDING APPARATUS

(75) Inventor: Yuhei Chiwata, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 285 days.

(21) Appl. No.: 12/837,080

(22) Filed: Jul. 15, 2010

(65) Prior Publication Data

US 2011/0012973 A1 Jan. 20, 2011

(30) Foreign Application Priority Data

Jul. 16, 2009 (JP) ..... 2009-167978

(51) Int. Cl.
*B41J 2/01* (2006.01)
*B41J 29/38* (2006.01)

(52) U.S. Cl. ..... 347/102; 271/16; 271/104

(58) Field of Classification Search ..... 347/14, 347/16, 101–104; 271/97, 211
See application file for complete search history.

(56) References Cited

FOREIGN PATENT DOCUMENTS

| | | | |
|---|---|---|---|
| JP | 8-175690 | A | 7/1996 |
| JP | 10-297813 | A | 11/1998 |
| JP | 2001-63019 | A | 3/2001 |

*Primary Examiner* — Stephen Meier
*Assistant Examiner* — Tracey McMillion
(74) *Attorney, Agent, or Firm* — Birch, Stewart, Kolasch & Birch, LLP

(57) ABSTRACT

The printed matter seasoning apparatus includes: a table on which a plurality of sheets of printed paper are placed in a stack, ink having been deposited on at least one surface of each sheet of the printed paper; and an air blowing device which blows air toward at least one of end sides of the stack on the table to supply the air simultaneously between the respective sheets in the stack. The air blowing device blows the air at an air flow volume of at least 0.02 $m^3$/(min·m) per sheet of the printed paper and per unit length of the printed paper in a width direction thereof perpendicular to a direction from the air blowing device to the stack on the table.

18 Claims, 12 Drawing Sheets

AIR FLOW VOLUME–STATIC PRESSURE CHARACTERISTICS OF AIR BLOWING UNITS, AND REGION OF ACHIEVING SATISFACTORY SEASONING

PRINTED MATTER SEASONING APPARATUS AND METHOD, AND INKJET RECORDING APPARATUS

BACKGROUND OF THE INVENTION

1. Field of the Invention

The present invention relates to a printed matter seasoning apparatus and method, and an inkjet recording apparatus, and more particularly, to a seasoning apparatus composition and a seasoning method, and to an inkjet recording apparatus using same, whereby paper after being printed is quickly conditioned close to the ambient temperature and humidity.

2. Description of the Related Art

In a printing system, immediately after ink has been deposited on paper, expansion and contraction of the paper occurs due to the difference in moisture content resulting from the light and dark tones of the ink (i.e., different ink volumes) in the image region. This problem is especially conspicuous in a system which prints onto normal paper using water-based ink Moreover, when carrying out double-side printing, normally, after completing printing on one side (the front surface), printing is carried out on the opposite side (the rear surface); however, immediately after printing on the front surface, there is significant expansion of the paper and a problem arises in that deviation occurs in the size and position of the images printed respectively on the front surface and the rear surface (i.e., there is mismatch in register on the front and rear surfaces).

In the case of single-side printing also, and not only double-side printing, there is a problem of deterioration of printing quality due to the occurrence of curl or cockling as a result of deformation of the paper as described above. Furthermore, there is also a problem of causing adverse effects on subsequent processing steps, such as a binding process, which are carried out after the printing step.

Japanese Patent Application Publication No. 2001-063019 discloses a printing apparatus having a composition to address the problem of scratches occurring in an image when the image rubs against guide members, and the like, if the drying of the front surface is insufficient when performing double-side printing. The printing apparatus has a composition in which a printed matter after printing on one side thereof (front surface) is output to the exterior of the printing apparatus, and drying is promoted by means of a heater or hot air flow on an output tray outside the printing apparatus, whereupon printing of the rear surface is carried out. This technology may have beneficial effects in respect of a single printed sheet; however, if the printing speed is raised and printed matters are stacked in the paper output tray, then it is not possible to obtain a sufficient drying effect.

Japanese Patent Application Publication No. 08-175690 discloses a paper jogger in which an air nozzle is arranged movably in the vertical direction by an end side of stacked printing paper, and sheets of paper are separated by blowing heated air from the air nozzle. The paper jogger is also provided with a member that presses the upper surface of the stack of sheets of printed paper to prevent scattering or distortion of the stacked sheets during the blowing of the heated air. This composition enables air to enter in between the stacked sheets of printed paper by blowing heated air from the air nozzle, and can also be expected to yield beneficial effects in respect of the drying of the printed paper. However, with the air nozzle that moves up and down, the air flow acts intermittently between the paper sheets, and therefore, although satisfactory performance is obtained in respect of the paper separating function, the drying speed is slow.

Japanese Patent Application Publication No. 10-297813 discloses a paper jogger which is provided with side walls surrounding the four end sides of stacked paper, and at least one of the side walls has an air blowing port, whereby air can be introduced from the air blowing port into the sheets of printed paper efficiently while preventing dispersion of the air to the exterior of the stacked paper. This composition may have satisfactory performance in terms of sheet separation; however, from the viewpoint of drying, it is difficult to exchange air between the paper sheets due to the closed structure surrounding the paper, and therefore the drying speed is slow.

SUMMARY OF THE INVENTION

The present invention has been contrived in view of these circumstances, an object thereof being to provide a seasoning apparatus and method, and an inkjet recording apparatus, whereby paper after being printed (printed matters) can be gathered in a stack and seasoned (adapted to the ambient humidity) uniformly in a short period of time.

In order to attain the aforementioned object, the present invention is directed to a printed matter seasoning apparatus, comprising: a table on which a plurality of sheets of printed paper are placed in a stack, ink having been deposited on at least one surface of each sheet of the printed paper; and an air blowing device which blows air toward at least one of end sides of the stack on the table to supply the air simultaneously between the respective sheets in the stack, the air blowing device blowing the air at an air flow volume of at least 0.02 $m^3/(min \cdot m)$ per sheet of the printed paper and per unit length of the printed paper in a width direction thereof perpendicular to a direction from the air blowing device to the stack on the table.

According to this aspect of the present invention, it is possible to pass an air flow of a required volume between the respective sheets of printed paper by directing the air flow of a volume that satisfies the above-described air blowing conditions toward at least one end side of the stack of printed paper on the table. Thus, the stack of printed matters can be seasoned uniformly and simultaneously, in a short period of time.

Preferably, the air blowing device blows the air of a static pressure not lower than 500 Pa.

Supposing a paper size which is widely used as a printing paper (for example, half Kiku of 636 mm×469 mm), a static pressure of 500 Pa or greater is desirable.

It is more preferable to simultaneously satisfy both of the following conditions: $q>0.02\ m^3/(min \cdot m)$, where q is the air flow volume passing per sheet of the printed paper and per unit length of the printed paper in the width direction thereof; and $P>500$ Pa, where P is the static pressure of the air blown from the air blowing device.

Preferably, the air blowing device blows the air of same temperature and humidity as surrounding environment.

It is desirable mode where peripheral air is directly blown, from the viewpoint of swiftly and uniformly adjusting the paper after being printed to the humidity of the surrounding environment.

Preferably, the air blowing device has air flow volume—static pressure characteristics which encompass a point representing a required air flow volume $Q=M \times Wp \times 0.02\ m^3/min$ and a required static pressure $P=500$ Pa, where M is a maximum number of processed sheets which the printed matter seasoning apparatus is capable of simultaneously processing, and Wp is a length, having unit of meter, of one side of the printed paper in the width direction thereof.

It is possible to calculate the required air flow volume Q from the maximum number of processed sheets M which can be accommodated on the table and the size of the paper Wp. It is possible to judge whether or not appropriate seasoning is possible by means of an air blowing device, from the positional relationship between a curve of the air flow volume—static pressure characteristics of the air blowing device and a point representing the required air flow volume $Q=M\times Wp\times 0.02\ m^3/min$ and the required static pressure P=500 Pa.

For example, when a curve of the characteristics of the air blowing device is plotted on a coordinates system where the horizontal axis represents the air flow volume (increasing toward the right-hand side) and the vertical axis represents the static pressure (increasing in the upward direction), then if the point that represents the required air flow volume of $Q=M\times Wp\times 0.02\ m^3/min$ and the required static pressure P=500 Pa lies on the characteristics curve or is situated in the region below the characteristics curve, then air blowing that satisfies prescribed air blowing conditions can be achieved by the air blowing device. It is desirable to employ the air blowing device that satisfies these conditions.

Preferably, the printed matter seasoning apparatus further comprises a ceiling plate member which is arranged over the table.

According to this aspect of the present invention, the printed paper is accommodated between the table and the ceiling plate member. The ceiling plate member serves to restrict the upward movement of the paper, thereby preventing scattering of the paper during the air blowing.

Preferably, a paper accommodating section is defined between the table and the ceiling plate member; and the air blowing device has an air blowing port of a size covering a whole region of the paper accommodating section in a height direction thereof.

By employing the air blowing device having the opening for the air blowing (air blowing port) that covers substantially the whole area of the paper accommodating section which is defined by the table and the ceiling plate member, it is possible to supply the air flow simultaneously to all of the sheets of printed paper accommodated in the paper accommodating section, and seasoning can be completed in a short period of time.

Preferably, the ceiling plate member is configured to move upward as the sheets of the printed paper float upward due to the air blown from the air blowing device.

When air blowing is started from the air blowing device, the sheets of paper float up due to the force of the air flow, thereby forming gaps between the sheets. Therefore, the paper position of the uppermost layer is raised during the air blowing. A desirable composition is one where the ceiling member is raised in accordance with the rising of the paper position and scattering of the paper is prevented while ensuring sufficient gaps between the paper sheets.

Preferably, the air blowing device blows the air from one of perimeter planes which are along the end sides of the stack on the table; an air passage port is arranged in another of the perimeter planes; and the air supplied between the sheets in the stack from the air blowing device escapes through the air passage port to exterior.

For example, the air passage port is formed in at least one of the four perimeter planes along the four sides of the printed paper. There is a mode where an opening or a cutaway portion which serves as the air passage port is formed in a side plate member of the corresponding plane. Furthermore, there is another mode where no side plate member is arranged and the corresponding plane is open. However, in this case, it is desirable that a restricting member is erected so as to restrict the movement of the paper toward the air passage port.

Preferably, the air blowing device blows the air in at least two directions toward at least two of the end sides of the stack on the table.

For example, the air blowing device is disposed so as to simultaneously perform air blowing toward two or three sides of the paper. By employing the composition that blows air from the plurality of directions, it is possible to carry out seasoning even more efficiently. Consequently, it is possible to achieve further improvement of the seasoning speed.

Preferably, the printed matter seasoning apparatus further comprises a side plate member which covers a portion of perimeter of the stack on the table in order to prevent leakage of the air blown from the air blowing device.

By arranging the side plate member, it is possible to blow the air flow efficiently between the paper sheets by restricting the air flow. Furthermore, the side plate member also serves to prevent flapping of the paper (for example, movement of the paper in the planar direction) during the blowing of air.

Preferably, the printed matter seasoning apparatus further comprises at least one shelf plate member with which the sheets of the printed paper are placed dividedly in a plurality of stacks.

When the number of stacked sheets becomes greater, it becomes more difficult for the air flow to pass by the sheets in the lower positions, due to the effects of gravity (the weight of the paper). In order to resolve this problem, it is possible to employ a composition in which, when many sheets of printed paper are accommodated on the table, the sheets of printed paper are dividedly placed in a suitable number of stacks on the shelf plate members. By dividing the paper accommodating section by means of the shelf plate members and thus creating a plurality of decks in the paper accommodating section, the weight of the paper stack divided into respective stages is supported by the respective shelf plate members and the table. By this means, the load of the paper weight is distributed and an air flow can be passed sufficiently through the paper stacked in the lower positions.

In the case of a composition where the paper sheets are dividedly stacked on the shelf plate members, a desirable mode is one where a plurality of air blowing units (air blowing devices) are arranged respectively for the paper accommodating ranges of the decks.

Preferably, the ink contains water as a solvent.

Seasoning by the seasoning apparatus according to the present invention is effective in the case of printed matters printed using the ink containing water as the solvent, since the water content tend to be high in such cases.

Preferably, the ink contains thermoplastic resin and coloring material.

Printed matters which use the ink containing thermoplastic resin are subjected to heat fixing after printing. During this heating step, the resin proceeds to form a film, and the image strength (durability) improves.

It is also preferable that the ink contains active light-curable resin and coloring material.

Instead of the thermoplastic resin described above, the ink can contain the active light-curable resin (for instance, an ultraviolet-curable monomer which is cured by ultraviolet light). In this case, by irradiating an active light beam (for example, ultraviolet light) onto an image after printing, the resin is cured and polymerized, and the image strength can be improved.

The above-described seasoning apparatus may be constituted as a separate apparatus to a printing apparatus, or may be combined with the printing apparatus and incorporated as a portion of a printing system.

In order to attain the aforementioned object, the present invention is also directed to an inkjet recording apparatus, comprising a paper output section which includes the above-described printed matter seasoning apparatus.

Printed matters produced by the inkjet method have a high water content compared to printed matters produced by other printing methods, and problems due to deformation of the paper are conspicuous, and therefore it is beneficial to carry out seasoning by using the seasoning apparatus according to the present invention in respect of printed matters printed by an inkjet recording apparatus.

In order to attain the aforementioned object, the present invention is also directed to a method of seasoning printed matter, comprising the steps of: placing a plurality of sheets of printed paper in a stack on a table, ink having been deposited on at least one surface of each sheet of the printed paper; and blowing air by an air blowing device toward at least one of end sides of the stack on the table to supply the air simultaneously between the respective sheets in the stack, the air being blown by the air blowing device at an air flow volume of at least 0.02 $m^3/(min \cdot m)$ per sheet of the printed paper and per unit length of the printed paper in a width direction thereof perpendicular to a direction from the air blowing device to the stack on the table.

According to the present invention, it is possible to pass an air flow of a required volume between sheets of printed paper stacked on the table, and a large number of printed matters can be seasoned uniformly in a short period of time. Consequently, it is possible to prevent expansion/contraction and deformation of the paper after printing, and it is also possible to improve productivity of the printed matters. Furthermore, according to the present invention, it is possible to prevent displacement in register on front and rear surfaces when carrying out double-side printing, and suitability for subsequent processes, such as a binding process, is also improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF THE PREFERRED EMBODIMENTS

Description of air blowing conditions required for seasoning

<Conditions of Air Flow Volume>

In order to carry out seasoning quickly in respect of a large number of printed matters (a stack of printed paper sheets), it is necessary to blow an air flow between the sheets at all times at a prescribed air flow volume or above. Suitable air flow volume conditions for seasoning were clarified by means of evaluation experiments as described below.

<Evaluation Method>

Figure 1:
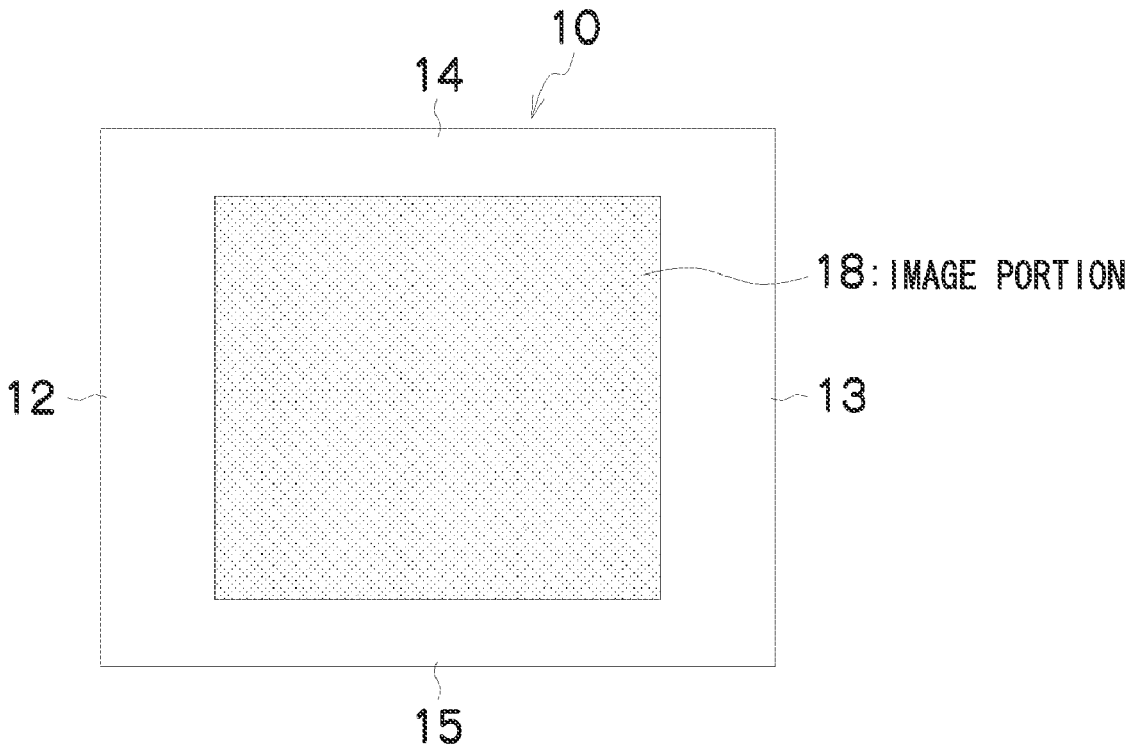
FIG. 1 is an illustrative diagram of a printed matter used for evaluating air flow volume conditions.

Step 1: As shown in FIG. 1, a solid image (an image portion denoted with reference numeral 18) was printed on the printed paper 10 by an inkjet recording apparatus, while appropriately leaving left-hand and right-hand margin portions 12 and 13 and upper and lower margin portions 14 and 15. Here, the remaining water volume contained in the image portion 18 after printing was approximately 2.5 $g/m^2$. A1 grade gloss coated paper made by Mitsubishi Paper Mills "Tokubishi Art double-side N" (product name) was used as the printing paper 10.

Figure 2A:
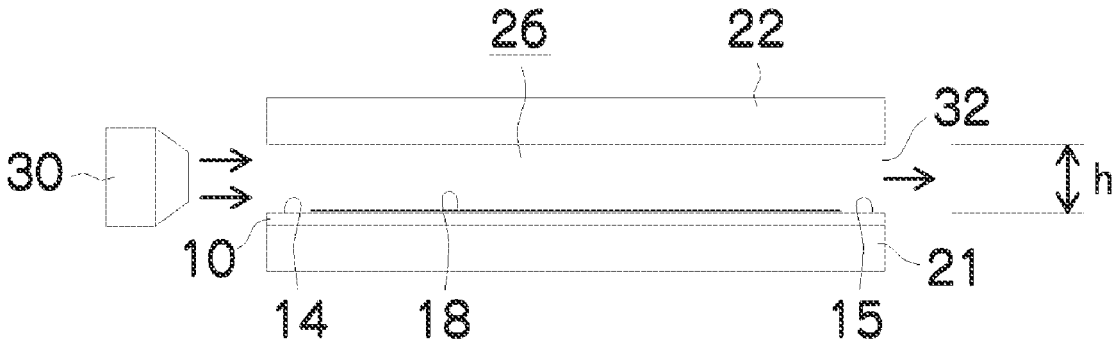
FIGS. 2A and 2B are illustrative diagrams for describing a method of evaluating air flow volume conditions.
Figure 2B:
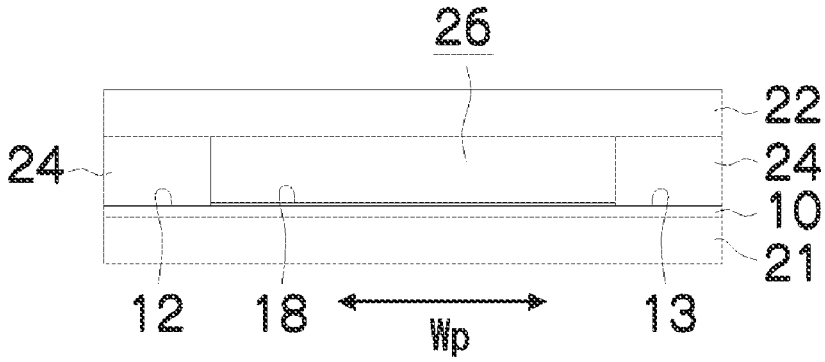

Step 2: After the printing, the printed paper (printed matter) was placed between two plates 21 and 22, and a gap 26 of a prescribed amount was produced with spacers 24 between the plates 21 and 22, as shown in FIGS. 2A and 2B. FIG. 2B is a diagram viewed from the side of a blower (air blowing device) 30 in FIG. 2A. More specifically, the printed paper 10 was placed with the image portion 18 facing upward on the plate 21, the spacers 24 of a prescribed thickness were placed on the left-hand and right-hand margin portions 12 and 13, and the plate 22 was placed on the spacers 24. The plate 21 was a member corresponding to a stacking table, and the plate 22 was a member corresponding to a ceiling plate. Thus, the gap of a prescribed height h was produced on the image portion 18 of the printed paper 10.

Step 3: Next, the blower 30 blew a flow of air into the gap 26. A Sanyo Electric Blower "San Ace B97 (9BMB24P2K01)" (product name) was used for the blower 30. The output air flow volume was controlled by controlling the input current of the blower.

The air flow speed v m/s was measured at an exit portion 32 of the air blowing path formed between the two plates 21 and 22 in FIG. 2A, and the air flow volume q per unit length of the paper in the breadthways direction thereof (Wp direction in FIG. 2B), $q=h \times v \times 60$ $m^3/(min \cdot m)$, was calculated using the height h of the gap 26 (corresponding to a gap between paper sheets). A Kanomax "Anemomaster Model 6004" (product name) was used for the air flow speed meter.

Step 4: After thus blowing the air flow for a prescribed period of time while maintaining the prescribed flow volume, the air blowing was halted, the paper 10 was removed and the amount of remaining water w g/m$^2$ was measured. The measurement method was as described below.

<<Water Amount Measurement Method>>

The amount of water contained in the printed paper 10 was measured by using a trace water content measurement apparatus (here, a Mitsubishi Chemical Analytech "CA-200" (product name) was used) on an extracted 3 cm by 3 cm measurement portion of the paper. The measured amount of water (g) was divided by the extracted surface area to derive the amount of water per unit surface area (g/m$^2$).

The term "remaining amount of water" is defined as the amount of water remaining after depositing and drying ink droplets, minus the amount of water contained in the paper before printing. In other words, the amount of water originally contained in the printing paper itself is subtracted, and only the amount of water originating from the ink deposited by printing is considered. The amount of water originally contained in the paper is measured separately using unprinted paper.

Step 5: The air blowing time whereby the remaining amount of water w measured through the steps 1 to 4 becomes less than 0.5 g/m$^2$ is defined as the seasoning time.

<Evaluation Results>

Figure 3:
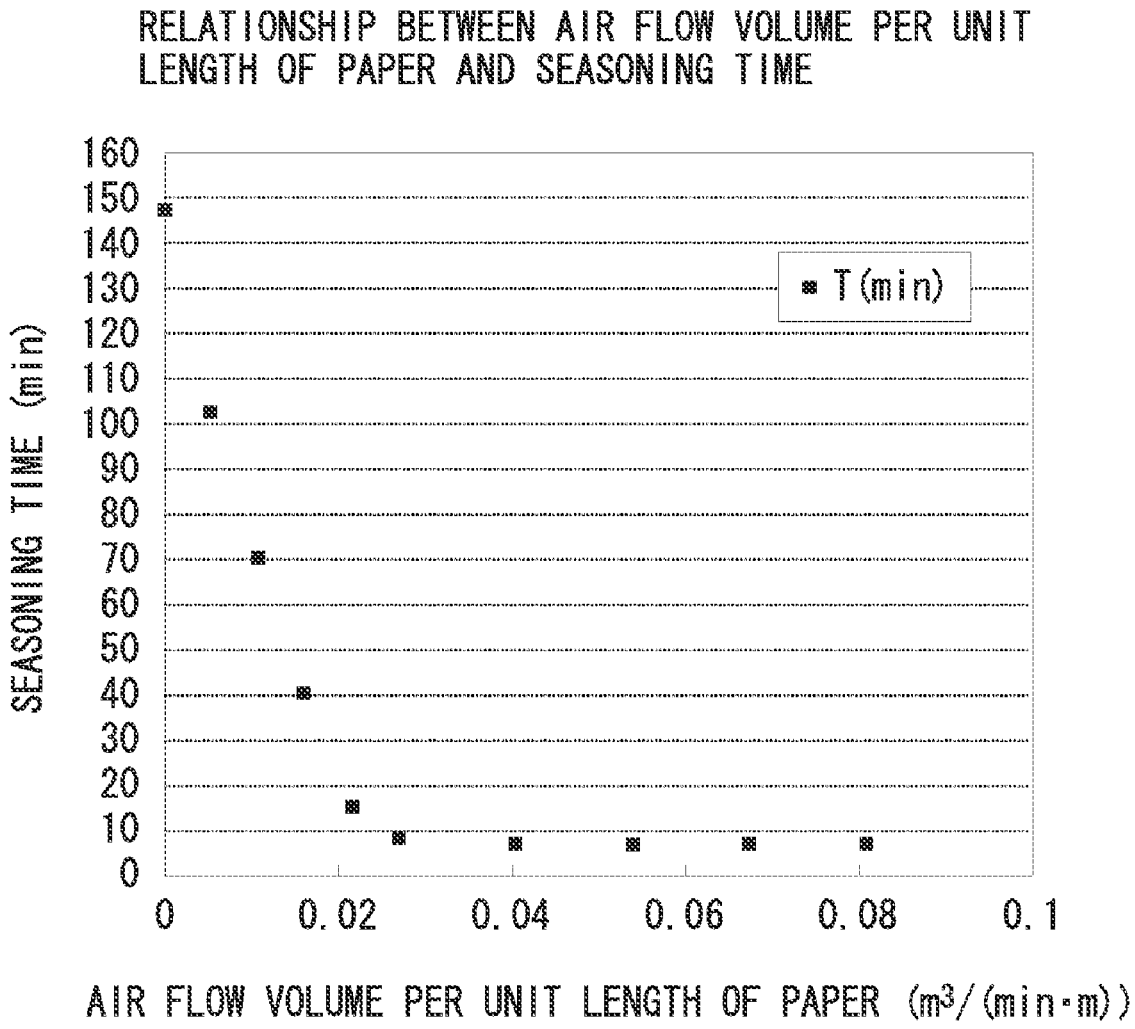
FIG. 3 is a graph showing the correlation between the air flow volume and seasoning time.

The relationship between the air flow volume per unit length of paper (air flow volume between sheets) and the seasoning time thus determined is shown in FIG. 3.

As FIG. 3 reveals, it was found that under conditions where the air flow volume q per unit length of paper was equal to or greater than 0.02 m$^3$/(min·m), rapid seasoning can be carried out in 15 minutes or less.

<Conditions of Air Flow Static Pressure>

In order to pass an air flow between a large number of printed matters (a stack of printed paper sheets), it is necessary to achieve a static pressure of the air flow that is sufficient to overcome the pressure loss. In general, a fluid passing between parallel plates has a pressure loss $P_{loss}$ (Pa) expressed as follows:

$$P_{loss} = 12\eta\frac{L}{h^2}V,$$

where V (m/s) is a flow speed of the fluid, h (m) is a gap between the parallel plates, L (m) is a flow channel length, and η (Pa·s) is a viscosity of the fluid.

The gap between paper sheets h is principally governed by the number of sheets stacked on the table, and the distance between the table and the ceiling. The greater the gap h, the greater the extent to which the pressure loss can be reduced, but there are restrictions in relation to increase in the size of the apparatus and the liability of flapping or folding of the paper to occur due to the blowing of air, and in practice the gap of approximately h=0.5 mm is desirable.

Figure 4:
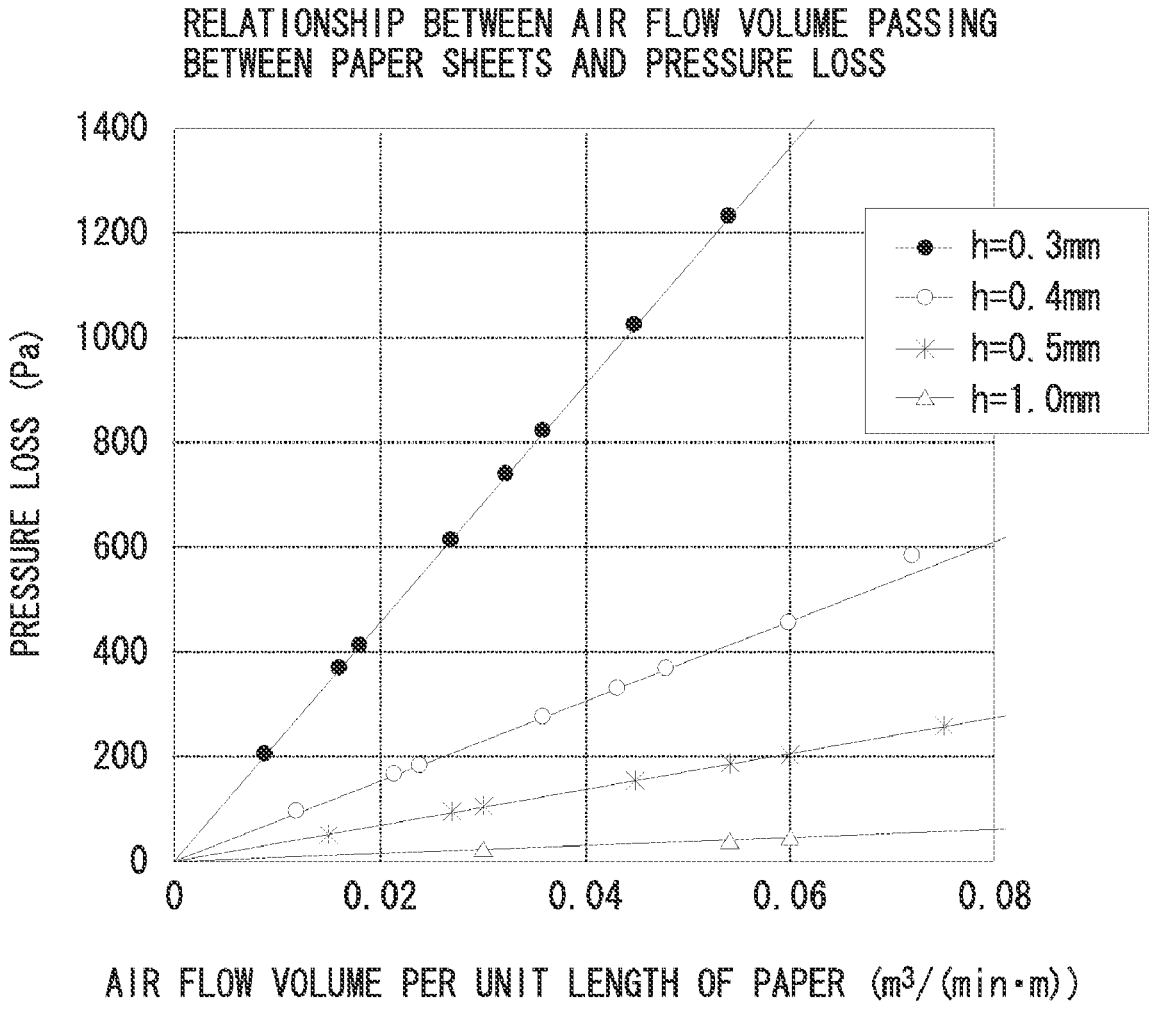
FIG. 4 is a graph showing the correlation between the air flow volume and pressure loss.

In this case, in relation to the air flow static pressure required in the air blowing device, the required air volume has to be satisfied at a paper gap of approximately h=0.3 mm, taking account of non-uniformities in the air flow. FIG. 4 shows the relationship between the flow volume passing between the paper sheets and the pressure loss, supposing that the air blowing distance L is 469 mm, equal to the dimension of the short side of the half Kiku size (636 mm×469 mm), which is commonly used as printing paper.

From FIG. 4, it is clear that an air flow static pressure of 500 Pa is necessary in order to satisfy the air flow volume q per unit length q=0.02 m$^3$/(min·m) at a gap of h=0.3 mm Composition of Seasoning Apparatus in Embodiment Next, the composition of a seasoning apparatus in an embodiment which satisfies the above-described air blowing conditions is explained.

Figure 5:
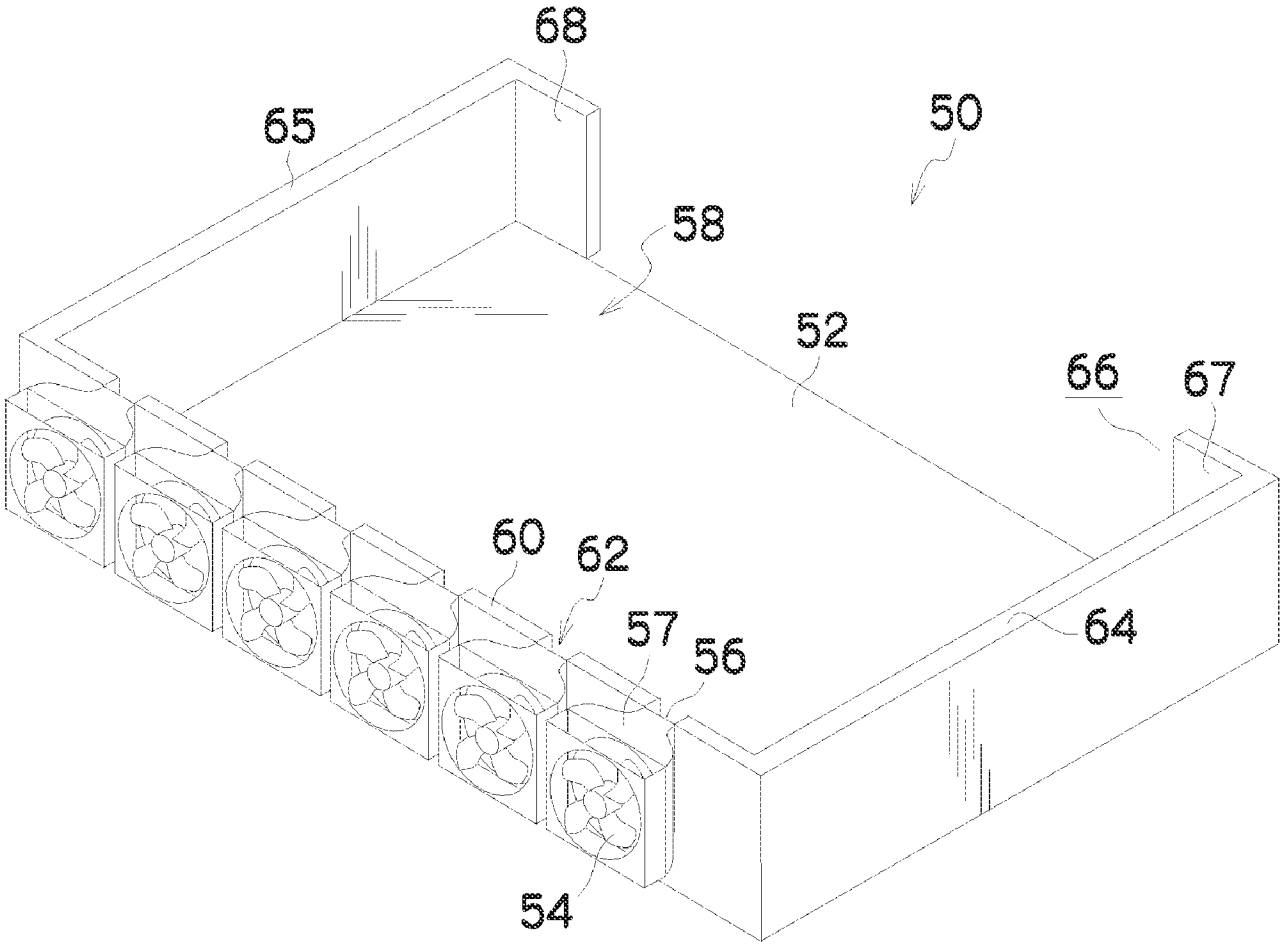
FIG. 5 is a perspective diagram of a seasoning apparatus according to an embodiment of the present invention.

FIG. 5 is a perspective diagram of a seasoning apparatus 50 according to an embodiment of the present invention. As shown in FIG. 5, the seasoning apparatus 50 includes a table 52, on which a plurality of sheets of printed paper (not shown in FIG. 5, hereinafter also referred to simply as "paper") can be stacked, and a blower 54, which blows an air flow over the outer perimeter face of the stack of paper placed on the table 52. In FIG. 5, an axial flow blower is depicted as the blower 54; however, there are no particular restrictions on the air blowing method, and it is also possible to use a centrifugal blower.

The seasoning apparatus 50 in the present embodiment has a composition in which air is blown over the end face of one side corresponding to the long side of rectangular paper, and a plurality of blowers 54 (six blowers 54 are shown in FIG. 5, for example) are arranged along the end face of this air blown side.

A cover (air blowing nozzle) 57 having an air blowing port 56 is attached at the blowing outlet side on each of the blowers 54. Each of the air blowing ports 56 has an opening length substantially equal to the height of the paper accommodating section in the paper stacking direction, in such a manner that an air flow is blown simultaneously throughout substantially the whole range of the paper accommodating section in the height direction, as defined by the table 52 and a ceiling plate 76 (not shown in FIG. 5, and shown in FIG. 6). This composition enables substantially uniform application of the air flow simultaneously to all of the sheets of paper stacked on the table 52. The number and specifications of the blowers 54 constituting the air blowing device, and the size and shape of the air blowing ports 56, and the like, are designed so as to obtain the air flow volume and pressure required to satisfy the air blowing conditions described above.

A side plate 60 is erected on the side where the blowers 54 are disposed, of the four perimeter sides on the table 52. The side plate 60 has openings or slits (hereinafter referred to as "blowing outlets 62") corresponding to the air blowing ports 56 of the blowers 54. Thereby adopting a composition which restricts the range of the air blowing outlets 62 and closes off the perimeters of the air blowing ports 56 of the blowers 54 with the wall member or the side plate 60, the direction of travel of the air flow blowing from the blowers 54 is restricted and leaking of air is prevented. Thus, it is possible to introduce the air flow generated by the blowers 54 efficiently into a paper accommodating section 58 on the table 52, and a strong air flow can be directed onto the stack of paper placed on the table 52.

Side plates 64 and 65 are erected on the left-hand and right-hand sides between which there is interposed the perimeter side of the table 52 where the blowers 54 are disposed. The side plates 64 and 65 close off the side planes of the two sides corresponding to the shorter sides of the printed paper placed on the table 52, and thereby prevent leaking of the air flow from the side faces, as well as restricting flapping movement of the sheets of paper.

On the other hand, an air passage port 66 is provided on the longer side face which opposes the side plate 60 where the blowers 54 are disposed. The size of the air passage port 66 can be designed as appropriate, and desirably as broad as possible a cross-sectional area is ensured so as not to impede the flow of air from the blowers 54. However, if this side plane were completely open throughout the whole length of the long side of the paper, it would be incurred that the sheets of paper are blown out and scattered from the table 52 during the blowing of air. Consequently, from the viewpoint of preventing scattering and falling of the paper, a desirable composition is one where side plates 67 and 68 are left or disposed in portions of the plane where the air passage port 66 is arranged, for example, in the vicinity of the corner portions of the paper as shown in FIG. 5. The side plates 67 and 68 function as restricting members which restrict flapping movement of the paper. The size of the side plates 67 and 68 is designed appropriately from the viewpoint of achieving both good stability in holding the paper and good ventilation on the table 52.

Furthermore, the height dimension of the side plates 60, 64, 65, 67 and 68 is designed appropriately in accordance with the maximum height of the stack of paper that can be set on the table 52.

Figure 6:
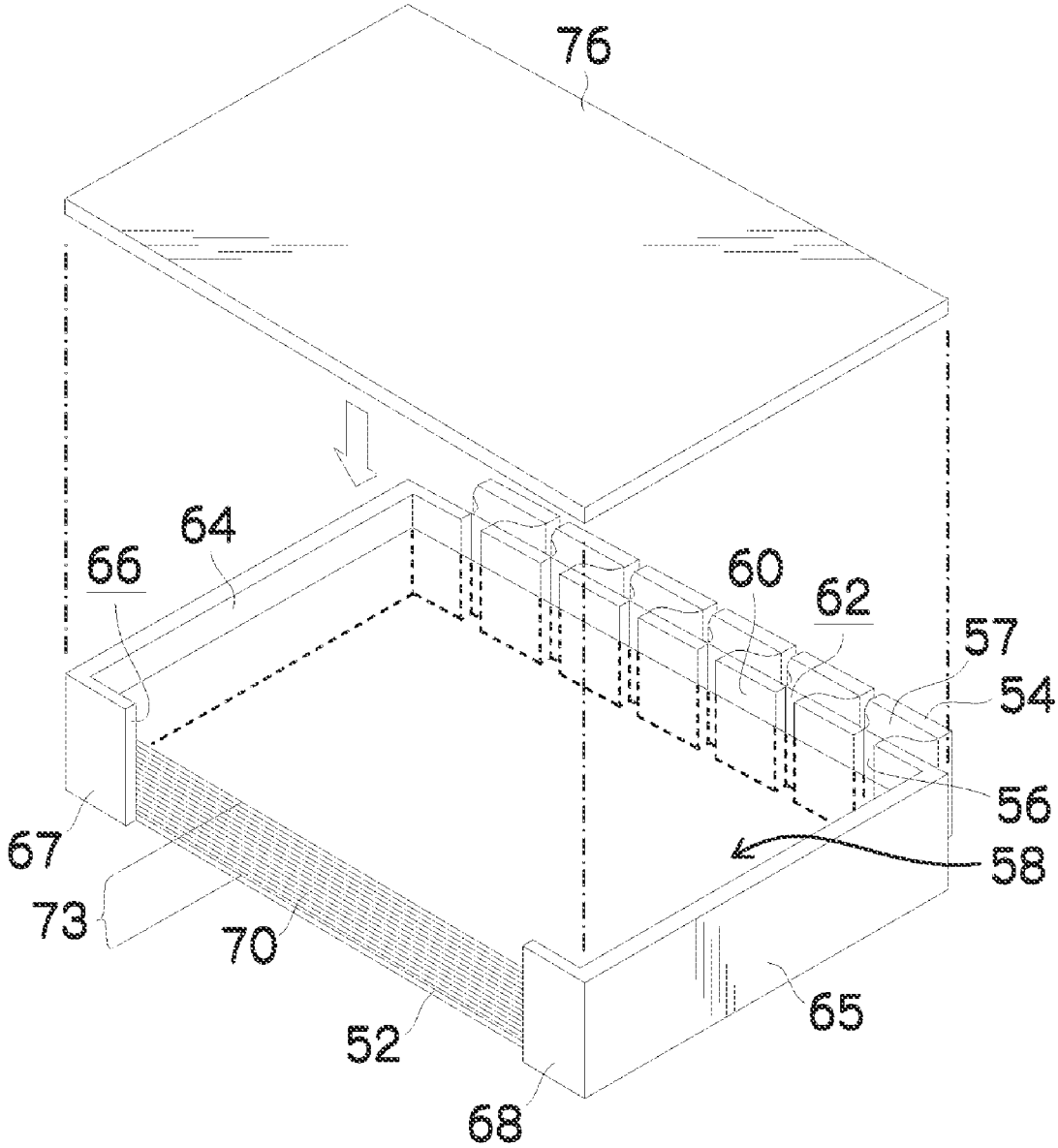
FIG. 6 is a perspective diagram showing a state where paper has been stacked in the seasoning apparatus in FIG. 5.

FIG. 6 is a perspective diagram of a state where a stack 73 of paper 70 has been set on the table 52, as viewed from the side of the air passage port 66. As shown in FIG. 6, the stack 73 of paper 70 after printing is placed on the table 52, and is covered from above with the ceiling plate 76. The ceiling plate 76 serves to prevent the paper 70 from flying upward during air blowing. The ceiling plate 76 may be fixed at a prescribed height position, for instance, so as to contact the upper end faces of the side plates 60, 64, 65, 67 and 68 and thereby close off the ceiling face of the paper accommodating section 58, or may adopt a composition whereby the height position of the ceiling plate 76 can be adjusted appropriately in accordance with the number of sheets of paper 70.

Figure 9:
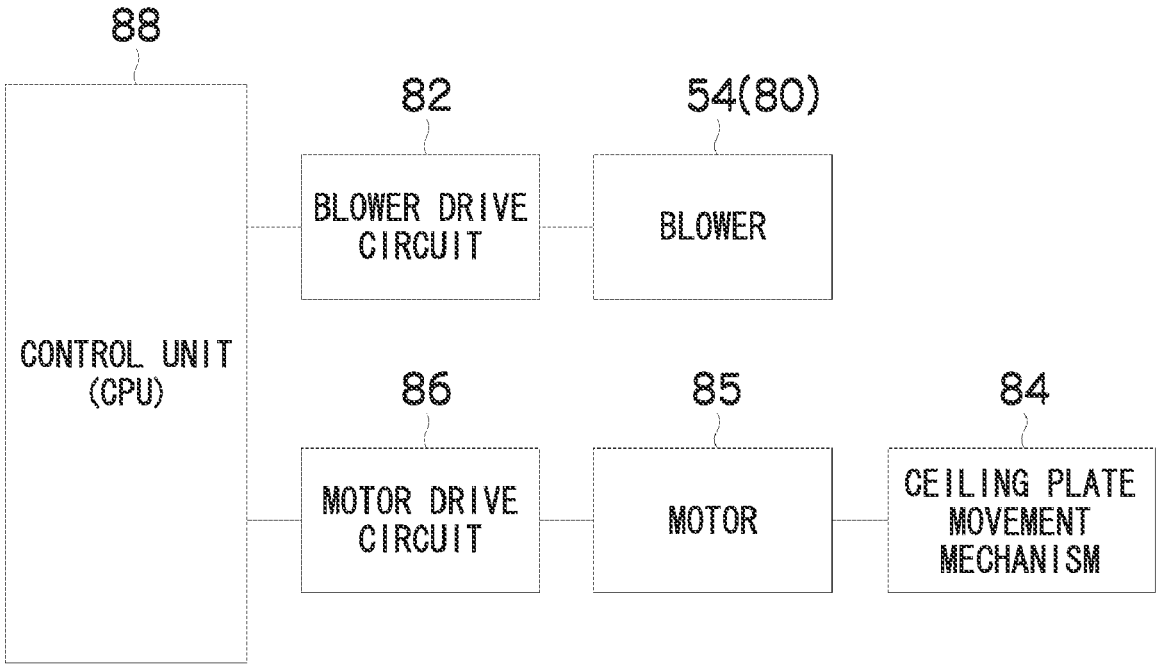
FIG. 9 is a block diagram showing a composition of a control system of the seasoning apparatus according to the embodiment of the present invention.

For instance, the ceiling plate 76 is arranged movably in the stacking direction of the paper 70, by means of a position adjusting device including a movement mechanism 84 (not shown in FIG. 6, and shown in FIG. 9). Consequently, the height position of the ceiling plate 76 is adjusted in accordance with the number of sheets of paper 70 disposed on the table 52, thereby forming the paper accommodating section 58 having a suitable height corresponding to the number of sheets for processing.

Moreover, the ceiling plate 76 may be arranged so as to be raisable at the start of air blowing. By starting the blowing of air from the blowers 54, air is supplied between the sheets of paper 70 on the table 52, thereby forming suitable gaps between the sheets of paper 70, and therefore the height position of each sheet of paper rises with the air blowing action. Consequently, the height position of the uppermost sheet of paper also rises up compared to when no air is being blown. Hence, a desirable composition is one where the ceiling plate 76 is raised up in accordance with the amount of floating up of the sheets of paper during the blowing of air. By adopting this composition, it is possible to ensure a suitable gap between the sheets of paper, as well as being able to suppress flapping of the sheets of paper due to the air blowing, and damage to the printed matter as a result of contact between the paper 70 and the ceiling plate 76 can be avoided.

Figure 7:
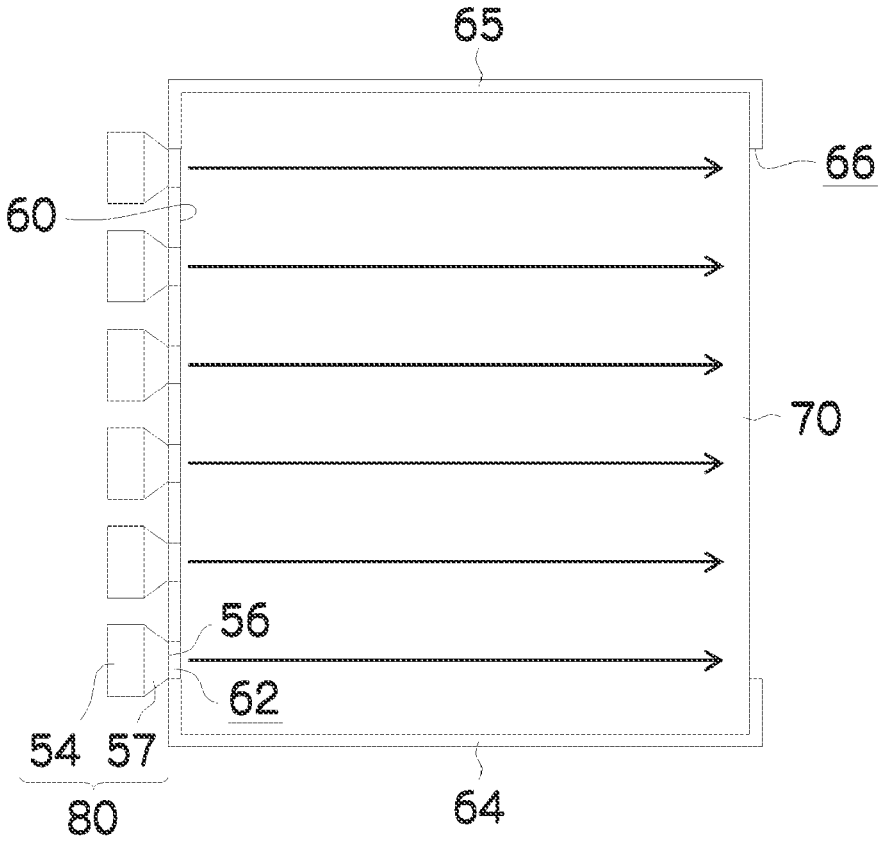
FIG. 7 is a plan diagram showing a schematic view of a state during air blowing.
Figure 8:
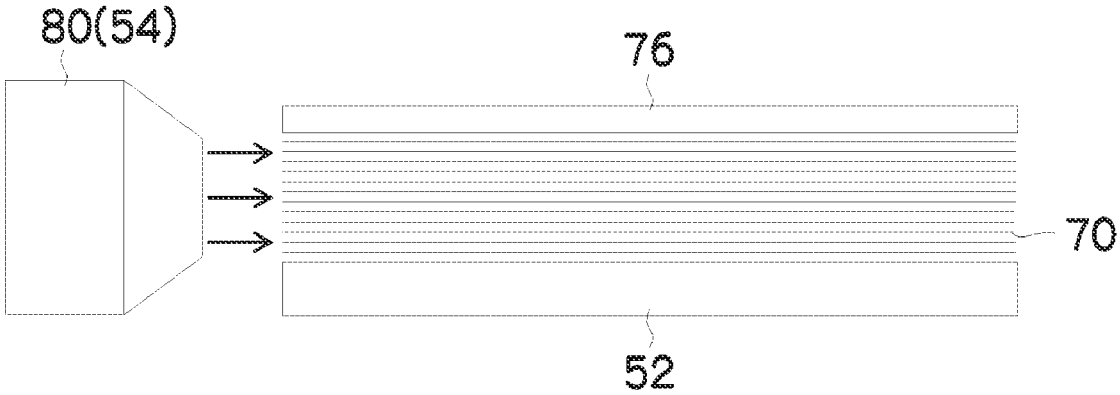
FIG. 8 is a side view diagram showing a schematic view of a state during air blowing.

FIG. 7 is a plan diagram showing a schematic view of a state during the air blowing, and FIG. 8 is a side view of same. In these drawings, reference numeral 80 denotes an air blowing unit including the blower 54 shown in FIGS. 5 and 6.

As shown in FIGS. 7 and 8, an air flow is directed from the end side of the paper 70 by the air blowing units 80, and is applied onto the end face of the stack 73 of paper 70. Since the chief aim of the seasoning apparatus 50 according to the present embodiment is to uniformize the water content in the paper 70 after printing, it is desirable that the air blowing units 80 blow the peripheral air (i.e., a flow of air having the temperature and humidity of the surrounding environment), from the viewpoint of preventing excessive drying. Supposing that a device is employed which blows an air flow of low humidity, such as air heated by a heater or the like (warm air flow), compressed air, dry air, or the like, then the remaining amount of water contained in the paper becomes lower than the ambient saturation point, and shrinkage of the paper occurs.

For example, if a low-humidity air flow is used, then although it is possible to carry out drying in a short period of time in regions where a large amount of ink has been deposited on the paper 70, an excessively dried state occurs in areas of the paper 70 where no ink has been deposited or regions where the amount of deposited ink is extremely small. Since the thus caused difference in the water content can produce expansion and contraction (i.e., deformation) of the paper, it is not desirable to employ a device that blows warm air or compressed air, or the like, having the temperature and humidity different to the ambient temperature and humidity.

In this respect, the air blowing units 80 in the present embodiment have a simple composition whereby the air that has the temperature and humidity of the surrounding environment is blown by the blowers 54 (see FIG. 5), and are not provided with any device for controlling and adjusting the temperature and humidity, such as a heating device or a dehumidifying device.

Thus, by blowing the air of the ambient temperature and humidity between the paper sheets by supplying the air from the surrounding environment by means of the air blowing units 80, the wet portions of the paper are dried, while the dry portions are wetted, thereby uniformizing the amount of water contained in the paper (so as to approach the ambient temperature and humidity).

FIG. 9 is a block diagram showing a composition of a control system of the seasoning apparatus 50 in the present embodiment. As shown in FIG. 9, the seasoning apparatus 50 in the present embodiment includes: a drive circuit 82, which drives the blowers 54; a motor 85, which drives the movement mechanism 84 of the ceiling plate 76; a drive circuit 86 of the motor 85; and a control unit (corresponding to a "control device") 88, which controls the drive circuits 82 and 86.

The control unit 88 is constituted of a central processing unit (CPU) and peripheral circuits thereof, for example, and supplies control signals to the drive circuits 82 and 86 in accordance with a prescribed program, thereby controlling the operation of the blowers 54 and the motor 85.

The seasoning apparatus 50 having this composition is able to supply air substantially uniformly between the sheets of paper 70, by blowing the air flow of a uniform volume continuously for a prescribed time period, from the end face of the stack of the sheets of paper 70 placed on the table 52, simultaneously with respect to the whole of the stack. Thereby, an air flow is passed over the entire surface of each sheet of paper 70, and the stack of paper 70 can thus be seasoned uniformly in a short period of time.

Capacity of Air Blowing Units and Seasoning Performance

The relationship between the capacity of the air blowing units and the seasoning performance was investigated under the following conditions.

Maximum number of sheets processed M=200 sheets

Length of a side (long side) of paper=636 mm (paper size: half Kiku of 636 mm×469 mm)

Required air flow volume $Q=200\times0.636\times0.02=2.54m^3/min$

Required static pressure P=500 Pa

The following compositions were compared as air blowing units.

Air blowing unit A: Sanyo Electric San Ace B97 (9BMB24P2K01)

Air blowing unit B: Matsushita Electric EH5402

Air blowing unit C: Sanyo Electric San Ace 92 (9G0924A2011)

Figure 10:
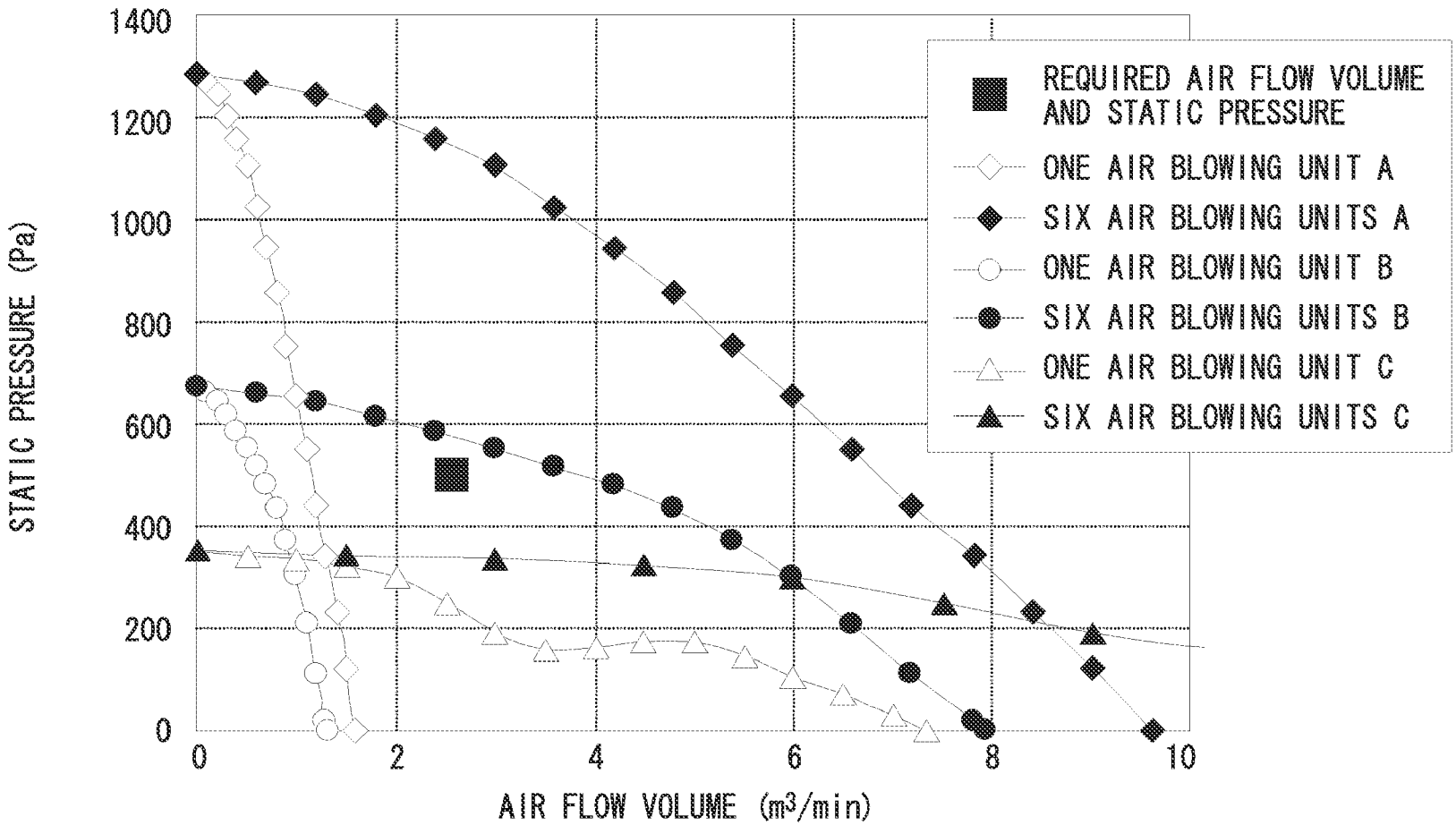
FIG. 10 is a graph showing the relationship between the air flow volume and static pressure characteristics of air blowing devices, and the air flow volume and static pressure conditions required to achieve good seasoning.

FIG. 10 is a graph showing the relationship between the air flow volume and the static pressure for different types and numbers of the air blowing units A to C. In FIG. 10, a large black square dot marks the point required in order to achieve satisfactory seasoning: "the required air flow volume Q=200×0.636×0.02=2.54 $m^3$/min" and "the required static pressure P=500 Pa". The required air flow volume Q is calculated by Q=M×Wp×0.02 $m^3$/min, where M is the maximum number of processed sheets and Wp (m) is the length of one side of the paper as viewed from the air blowing direction.

As shown in FIG. 10, the "air flow volume-static pressure" characteristics (Q-P characteristics) in a case where the air blowing device is constituted of six air blowing units A or of six air blowing units B encompass the point (Q, P) that indicates the minimum required air blowing conditions described above.

Therefore, rapid seasoning can be achieved by using the air blowing device constituted of six air blowing units A or six air blowing units B.

On the other hand, when an air blowing device is constituted of six air blowing units C, the required static pressure P=500 Pa is not satisfied and rapid seasoning is difficult to achieve.

Similarly, a composition where one of each of the air blowing units A to C is used also fails to simultaneously satisfy the required air flow volume Q and the required static pressure P, and therefore it is difficult to achieve rapid seasoning.

When the point representing the required air flow volume value Q=M×Wp×0.02 $m^3$/min and the required static pressure value P=500 Pa is compared with the characteristics curve of the air blowing device, then it is possible to achieve air blowing that satisfies prescribed air blowing conditions by means of the air blowing device, if the point representing the required air blowing conditions is situated on the characteristics curve or in the region below the characteristics curve.

Since excessive flapping of the paper occurs, leading to folding of the paper and damage to the image, if the air flow volume and the static pressure are excessive, then the upper limits of the air flow volume and the static pressure during air blowing are determined so as to prevent excessive flapping movement of the paper.

Modified Embodiment 1

Figure 11:
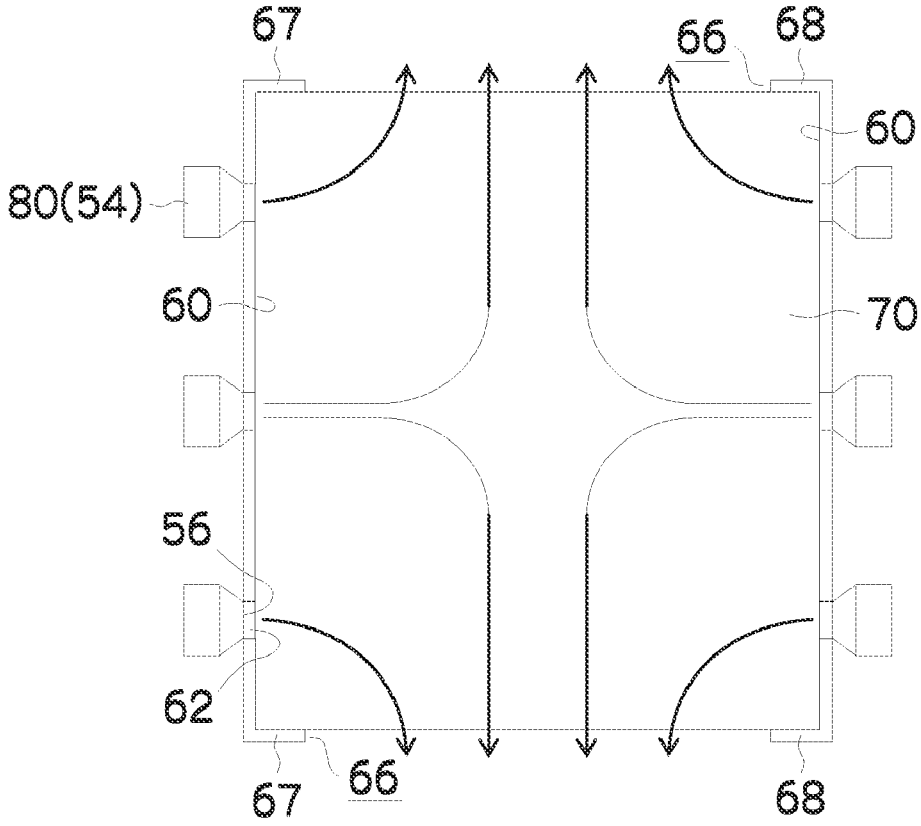
FIG. 11 is a plan diagram showing a schematic view of a state during air blowing in a seasoning apparatus according to another embodiment of the present invention.
Figure 12:
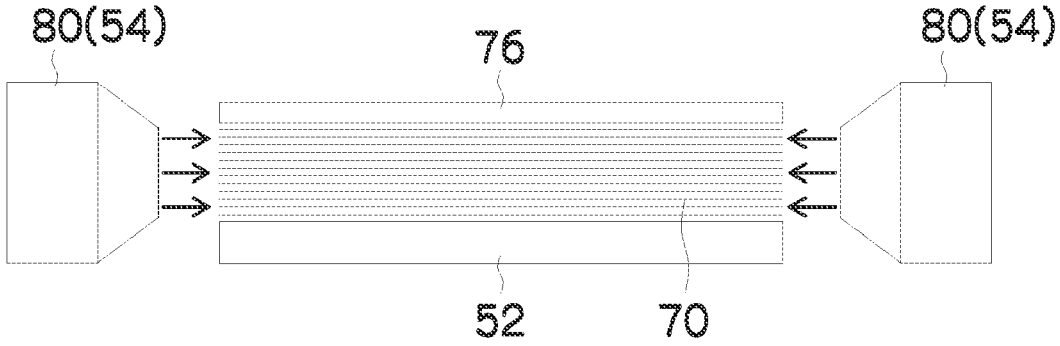
FIG. 12 is a side view diagram of the composition shown in FIG. 11.

FIGS. 11 and 12 are schematic drawings showing a seasoning apparatus according to another embodiment of the present invention. FIG. 11 is a plan diagram showing a schematic view of a state during air blowing, and FIG. 12 is a side view of same. In FIGS. 11 and 12, elements which are the same as or similar to the composition described with reference to FIGS. 5 to 9 are denoted with the same reference numerals, and description thereof is omitted here.

As shown in FIGS. 11 and 12, it is also possible to adopt a mode where an air flow is blown from each of two end sides of the paper 70 stacked on the table 52. In this case, the air passage ports 66 are formed in the side planes where the air blowing units 80 (blowers 54) are not arranged.

According to this mode, compared to the mode where the air blowing is performed in a single direction, it is possible to reduce the effects of the pressure loss due to the passage of air through the gaps between the paper sheets, and efficient air blowing can be achieved.

Although not shown in the drawings, it is also possible to employ a composition where air is blown from three end sides of the paper.

Modified Embodiment 2

Figure 13:
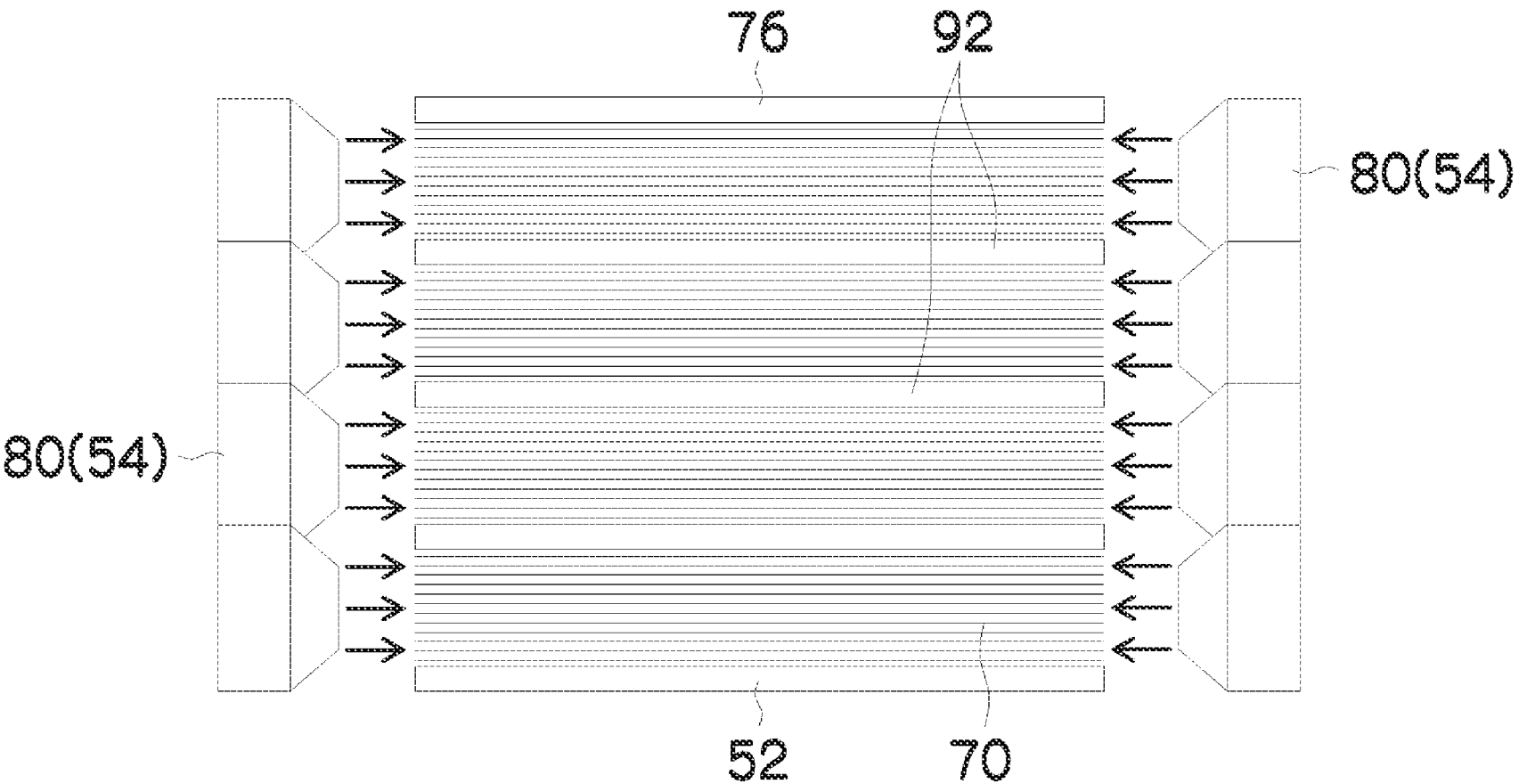
FIG. 13 is a principal part schematic drawing showing a seasoning apparatus according to yet another embodiment of the present invention.

FIG. 13 is a schematic drawing showing a seasoning apparatus according to yet another embodiment of the present invention. FIG. 13 is a side view diagram showing a schematic view of a state during air blowing. In FIG. 13, elements which are the same as or similar to the composition described with reference to FIGS. 5 to 9 are denoted with the same reference numerals, and description thereof is omitted here.

As shown in FIG. 13, it is possible to adopt a composition in which shelf plates 92 are arranged in the paper accommodating section on the table 52, and the sheets of paper 70 are stacked on a plurality of decks separately. FIG. 13 shows an example in which the paper accommodating section is divided into four decks by three shelf plates 92, and the number of shelf plates 92 can be suitably set to one or more, in accordance with the number of decks to be divided. By arranging n shelf plates 92 between the table 52 and the ceiling plate 76, a paper accommodating section having (n+1) decks is prepared.

For the device which puts the paper 70 in and out the respective decks of the paper accommodating section, it is possible to employ a commonly known structure having drawers, for example. Although the detailed structure is not shown in the drawings, it is possible to independently draw out each deck of the paper accommodating section and set a stack of paper thereon. A plurality of air blowing units 80 are arranged respectively for the separate decks, and uniform air blowing can be achieved for the paper stacks on the respective decks.

According to this mode, it is possible to pass a sufficient air flow over the sheets of paper stacked in lower levels, and therefore a large number of sheets of paper 70 can be seasoned in a short period of time.

The composition of the shelf divisions shown in FIG. 13 may also be employed in the mode described with reference to FIGS. 5 to 9.

Timing of Carrying Out Seasoning

There are no particular restrictions on the timing of carrying out seasoning, and seasoning is carried out at the following timings, for example.

(1) When single-side printing only is being performed, seasoning is carried out after printing on the single surface.

(2) When double-side printing is being performed, seasoning is carried out after printing the front surface and before printing the rear surface.

(3) When double-side printing is being performed, in addition to the case in (2), seasoning is also carried out after printing the rear surface.

Embodiment of Application to Inkjet Printing System

A printing system which combines the seasoning apparatus shown in FIGS. 1 to 13 and an inkjet printing apparatus according to an embodiment of the present invention is now described.

Figure 14:
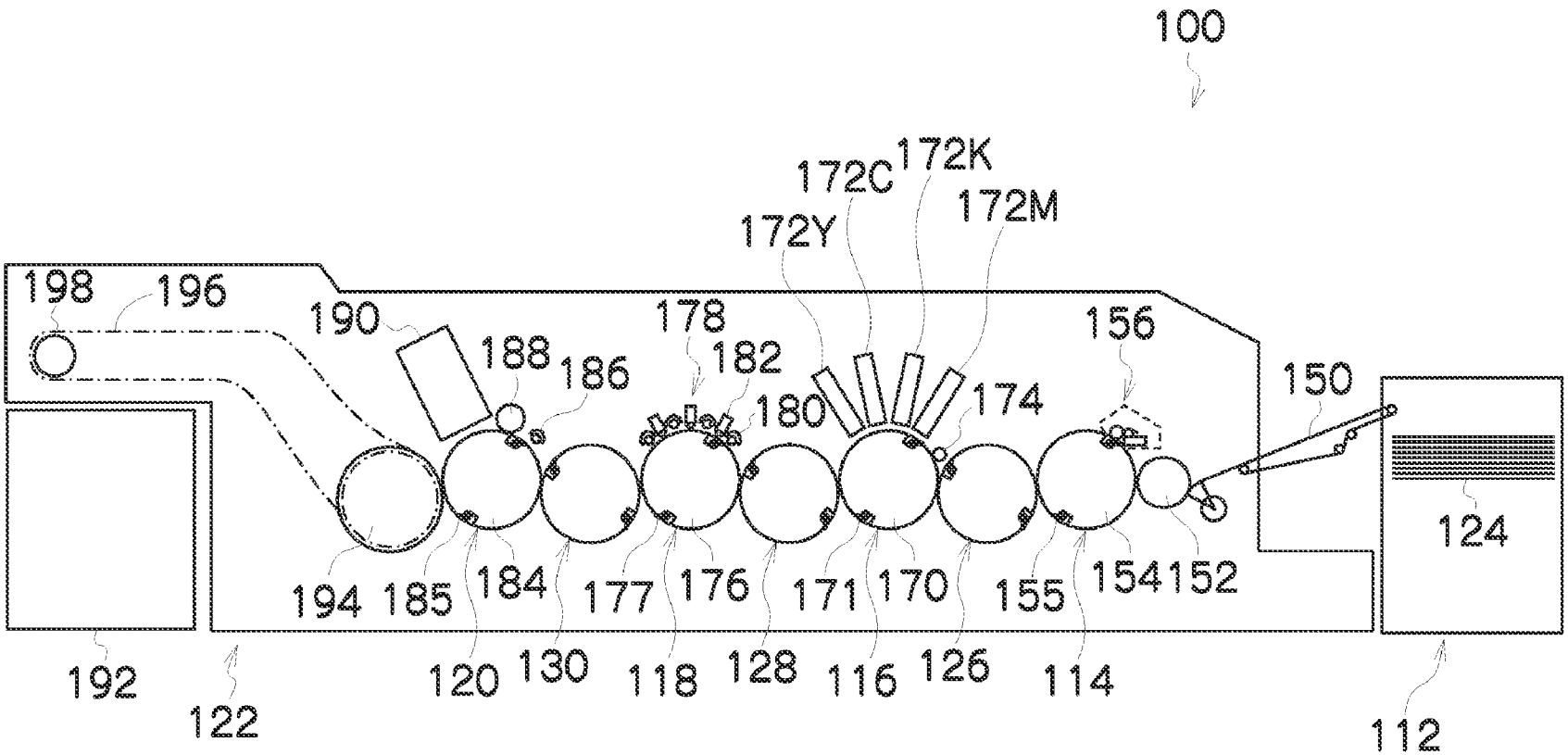
FIG. 14 is a schematic drawing of an inkjet recording apparatus according to an embodiment of the present invention.

FIG. 14 is a structural diagram illustrating the configuration of an inkjet recording apparatus 100 according to an embodiment of the present invention. The inkjet recording apparatus 100 is an inkjet recording apparatus of a so-called pressure-drum direct image-formation system which records a desired color image on a recording medium (hereinafter also referred to as "paper") 124 held on a pressure drum (an image formation drum 170) of an image formation unit 116 by ejecting and depositing droplets of ink of a plurality of colors from inkjet heads 172M, 172K, 172C and 172Y onto the recording medium 124. More specifically, the inkjet recording apparatus 100 is a recording apparatus of a on-demand type which adapts a two-liquids reaction (aggregation in the present embodiment) system in which treatment liquid (aggregation treatment liquid in the present embodiment) is applied onto the recording medium 124 prior to the deposition of the ink, so that the deposited ink reacts with the treatment liquid to form images on the recording medium 124.

The inkjet recording apparatus 100 includes a paper feed unit 112, a treatment liquid application unit 114, the image formation unit 116, a drying unit 118, a fixing unit 120, and a paper output unit 122 as the main components.

The seasoning apparatus 50 described with reference to FIGS. 1 to 13 is disposed in the portion of an output tray 192 of the paper output unit 122 (see FIG. 14).

<Paper Feed Unit>

The paper feed unit 112 feeds the recording medium 124 to the treatment liquid application unit 114. The recording medium 124 (paper sheets) is stacked in the paper feed unit 112. The paper feed unit 112 is provided with a paper feed tray 150, and the recording medium 124 is fed, sheet by sheet, from the paper feed tray 150 to the treatment liquid application unit 114.

In the inkjet recording apparatus 100 according to the present embodiment, it is possible to use recording media 124 of different types and various sizes as the recording medium 124. A mode can be adopted in which the paper feed unit 112 is provided with a plurality of paper trays (not illustrated) in which recording media of different types are respectively sorted and stacked, and the paper that is fed to the paper feed tray 150 from the paper trays is automatically switched, and a mode can also be adopted in which an operator selects or exchanges the paper tray in accordance with requirements. In the present embodiment, cut sheets of paper are used as the recording media 124, but it is also possible to cut paper to a required size from a continuous roll of paper and then supply this paper.

<Treatment Liquid Application Unit>

The treatment liquid application unit 114 is a mechanism that applies the treatment liquid to the recording surface of the recording medium 124. The treatment liquid includes a coloring material aggregating agent that causes the aggregation of a coloring material (pigment in the present embodiment) included in the ink applied in the image formation unit 116, and the separation of the coloring material and a solvent in the ink is enhanced when the treatment liquid is brought into contact with the ink As shown in FIG. 14, the treatment liquid application unit 114 includes a paper transfer drum 152, a treatment liquid drum 154, and a treatment liquid application device 156. The treatment liquid drum 154 is a drum that holds and rotationally conveys the recording medium 124. The treatment liquid drum 154 is provided on the outer circumferential surface thereof with a hook-shaped holding device (gripper) 155, which holds the leading end of the recording medium 124 by gripping the recording medium 124 between the hook of the gripper 155 and the circumferential surface of the treatment liquid drum 154. The treatment liquid drum 154 may be provided with suction apertures on the outer circumferential surface thereof and connected to a suction device that performs suction from the suction apertures. As a result, the recording medium 124 can be tightly held on the outer circumferential surface of the treatment liquid drum 154.

The treatment liquid application device 156 is provided on the outside of the treatment liquid drum 154 opposite the outer circumferential surface thereof. The treatment liquid application device 156 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 124 that is held by the treatment liquid drum 154, so as to transfer the treatment liquid metered by the anilox roller to the recording medium 124. The treatment liquid application device 156 can apply the treatment liquid onto the recording medium 124 while metering.

In the present embodiment, the application system using the roller is used; however, the present invention is not limited to this, and it is possible to employ a spraying method, an inkjet method, or other methods of various types.

The recording medium 124 that has been applied with the treatment liquid in the treatment liquid application unit 114 is transferred from the treatment liquid drum 154 through the intermediate conveyance unit 126 to the image formation drum 170 of the image formation unit 116.

<Image Formation Unit>

The image formation unit 116 includes the image formation drum 170, a paper pressing roller 174 and the inkjet heads 172M, 172K, 172C and 172Y. Similar to the treatment liquid drum 154, the image formation drum 170 is provided on the outer circumferential surface thereof with a hook-shaped holding device (gripper) 171. The recording medium 124 held on the image formation drum 170 is conveyed in a state where the recording surface thereof faces outward, and inks are deposited on the recording surface by the inkjet heads 172M, 172K, 172C and 172Y The inkjet heads 172M, 172K, 172C and 172Y are recording heads (inkjet heads) of the inkjet system of the full line type that have a length corresponding to the maximum width of the image formation region in the recording medium 124. A nozzle row is formed on the ink ejection surface of the inkjet head. The nozzle row has a plurality of nozzles arranged therein for discharging ink over the entire width of the image recording region. Each of the inkjet heads 172M, 172K, 172C and 172Y is fixedly disposed so as to extend in the direction perpendicular to the conveyance direction (rotation direction of the image formation drum 170) of the recording medium 124.

Droplets of corresponding colored inks are ejected from the inkjet heads 172M, 172K, 172C and 172Y toward the recording surface of the recording medium 124 held tightly on the image formation drum 170, and thereby the ink comes into contact with the treatment liquid that has been heretofore applied on the recording surface by the treatment liquid application unit 114, the coloring material (pigment) dispersed in the ink is aggregated, and a coloring material aggregate is formed. Thus, the coloring material flow on the recording medium 124 is prevented, and an image is formed on the recording surface of the recording medium 124.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

The recording medium 124 on which the image has been formed in the image formation unit 116 is transferred from the image formation drum 170 through an intermediate conveyance unit 128 to a drying drum 176 of the drying unit 118.

<Drying Unit>

The drying unit 118 dries water included in the solvent separated by the coloring material aggregation action. As shown in FIG. 14, the drying unit includes the drying drum 176 and a solvent dryer 178.

Similar to the treatment liquid drum 154, the drying drum 176 is provided on the outer circumferential surface thereof with a hook-shaped holding device (gripper) 177, which can hold the recording medium 124 by gripping the leading end portion of the recording medium 124.

The solvent dryer 178 is disposed in a position facing the outer circumferential surface of the drying drum 176, and includes a plurality of halogen heaters 180, and a plurality of warm-air blow-out nozzles 182, each of which is arranged between adjacent two of the halogen heaters 180.

Each of the warm-air blow-out nozzles 182 is controlled to blow warm air at appropriate temperature at an appropriate blowing rate toward the recording medium 124, and each of the halogen heaters 180 is controlled to appropriate temperature, and it is thereby possible to implement various drying conditions.

The surface temperature of the drying drum 176 is set to 50° C. or above. By heating from the rear surface of the recording medium 124, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176 (namely, preventing burns due to high temperature), desirably, the surface temperature of the drying drum 176 is not higher than 75° C. (and more desirably, not higher than 60° C.).

By holding the recording medium 124 in such a manner that the recording surface thereof is facing outward on the outer circumferential surface of the drying drum 176 (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

The recording medium 124 which has been subjected to the drying treatment in the drying unit 118 is transferred from the drying drum 176 through an intermediate conveyance unit 130 to a fixing drum 184 of the fixing unit 120.

<Fixing Unit>

The fixing unit 120 includes a fixing drum 184, a halogen heater 186, a fixing roller 188, and an inline sensor 190. Similar to the treatment liquid drum 154, the fixing drum 184 is provided on the outer circumferential surface thereof with a hook-shaped holding device (gripper) 185, which can hold the recording medium 124 by gripping the leading end portion of the recording medium 124. The recording medium 124 is conveyed by rotation of the fixing drum 184 in a state where the recording surface thereof faces outward, and the preheating by the halogen heater 186, the fixing treatment by the fixing roller 188 and the inspection by the inline sensor 190 are performed with respect to the recording surface.

The halogen heater 186 is controlled to a prescribed temperature (for example, 180° C.), by which the preheating is performed with respect to the recording medium 124.

The fixing roller 188 is a roller member which applies pressure and heat to the dried ink to melt and fix the self-dispersible polymer particles in the ink so as to transform the ink into the film. More specifically, the fixing roller 188 is arranged so as to be pressed against the fixing drum 184, and a nip roller is configured between the fixing roller 188 and the fixing drum 184. As a result, the recording medium 124 is squeezed between the fixing roller 188 and the fixing drum 184, nipped under a prescribed nip pressure (for example, 0.15 MPa), and subjected to fixing treatment.

Further, the fixing roller 188 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 124 is heated with the heating roller, thermal energy not lower than a Tg temperature (glass transition temperature) of a latex included in the ink is applied and latex particles are melted. As a result, fixing is performed by penetration into the projections-recessions of the recording medium 124, the projections-recessions of the image surface are leveled out, and gloss is obtained.

The fixing unit 120 in the embodiment shown in FIG. 4 is provided with the single fixing roller 188; however, it is possible that the fixing roller 188 has a configuration provided with a plurality of steps, depending on the thickness of image layer and Tg characteristic of latex particles.

On the other hand, the inline sensor 190 is a measuring device which measures the check pattern, moisture amount, surface temperature, gloss, and the like of the image fixed to the recording medium 124. A CCD sensor or the like can be used for the inline sensor 190.

With the fixing unit 120 of the above-described configuration, the latex particles located within a thin image layer formed in the drying unit 118 are melted by application of pressure and heat by the fixing roller 188. Thus, the latex particles can be reliably fixed to the recording medium 124. The surface temperature of the fixing drum 184 is set to 50° C. or above. Drying is promoted by heating the recording medium 124 held on the outer circumferential surface of the fixing drum 184 from the rear surface, and therefore breaking of the image during fixing can be prevented, and furthermore, the strength of the image can be increased by the effects of the increased temperature of the image.

Instead of the ink containing the high-boiling-point solvent and the polymer particles (thermoplastic resin particles), it is also possible to use an ink containing a monomer which can be polymerized and cured by exposure to ultraviolet (UV) light. In this case, the inkjet recording apparatus 100 includes a UV exposure unit for exposing the ink on the recording medium 124 to UV light, instead of the heat and pressure fixing unit including the heat roller (fixing roller 188). If using an ink containing an active light-curable resin, such as a UV-curable resin, then the inkjet recording apparatus 100 is thus provided with a device which irradiates the active light, such as a UV lamp or a UV laser diode (LD) array, instead of the fixing roller 188 for heat fixing.

<Paper Output Unit>

As shown in FIG. 14, the paper output unit 122 is provided after the fixing unit 120. The paper output unit 122 includes the output tray 192, and a transfer drum 194, a conveying belt 196, and a tension roller 198 are provided between the output tray 192 and the fixing drum 184 of the fixing unit 120 so as to face the output tray 192 and the fixing drum 184. The recording medium 124 is fed by the transfer drum 194 onto the conveying belt 196 and outputted onto the output tray 192.

The seasoning apparatus 50 described with reference to FIGS. 1 to 13 is used as the output tray 192, and serves as the seasoning device and also as the table on which the paper sheets after printing (printed matters) are stacked.

<Other Units>

Although not shown in the drawings, the inkjet recording apparatus 100 in the present embodiment also includes, in addition to the above-described units: an ink storing and loading unit for supplying the inks to the inkjet heads 172M, 172K, 172C and 172Y; a treatment liquid supply unit for supplying the treatment liquid to the treatment liquid application unit 114; a head maintenance unit for cleaning the inkjet heads 172M, 172K, 172C and 172Y (e.g., wiping of the nozzle surface, purging, and suction for the nozzles); position determination sensors for determining the position of the recording medium 124 in the medium conveyance path; and temperature sensors for measuring temperature in the respective parts of the inkjet recording apparatus 100.

<Adaptation to Double-Side Printing>

When carrying out double-side printing in the inkjet recording apparatus 100 shown in FIG. 14, seasoning is carried out for a prescribed period of time by the seasoning apparatus 50, after printing on one surface (the front surface) of the paper. The stack of paper which has undergone a seasoning process is then returned to the paper supply unit 112, and rear surface printing is carried out.

By this means, it is possible to achieve satisfactory double-side printing in a short period of time, without the occurrence of front/rear registration errors, or the like.

Furthermore, in the inkjet recording apparatus 100 shown in FIG. 14, it is also possible to adopt a composition in which a plurality of seasoning apparatuses 50 are provided for use in the output tray 192 and the seasoning apparatuses 50 can be moved between the paper output section 122 and the paper supply unit 112.

For example, it is possible to employ a composition in which the seasoning apparatuses 50 can travel by being provided with casters, and it is also possible to adopt a composition where the seasoning apparatuses 50 travel on rails.

While a first seasoning apparatus is seasoning a stack of printed matters, another (second) seasoning apparatus is set in the paper output section 122 and receives printed matters which are newly printed and output. The stack of paper that has completed seasoning by the first seasoning apparatus is supplied to the paper supply unit 112.

When a prescribed number of printed matters have been stacked in the second seasoning apparatus, the second seasoning apparatus is withdrawn from the paper supply unit 122 and starts a seasoning operation. A third seasoning apparatus or the first seasoning apparatus that has become empty is set in the paper supply unit 122 and printing is continued. By composing the system by using the plurality of seasoning apparatuses in rotation in this way, it is possible to achieve automated operation, as well as being able to produce a large number of printed matters with good efficiency.

Ink

The ink used in the present embodiment is aqueous ink containing water as a solvent, and more specifically, for example, an aqueous pigment ink that contains the following materials insoluble to the solvent (water): pigment particles as the coloring material, and the polymer particles.

It is desirable that the concentration of the solvent-insoluble materials in the ink is not less than 1 wt % and not more than 20 wt %, taking account of the fact that the viscosity of the ink suitable for ejection is 20 mPa·s or lower. It is more desirable that the concentration of the pigment in the ink is not less than 4 wt %, in order to obtain good optical density in the image.

It is desirable that the surface tension of the ink is not less than 20 mN/m and not more than 40 mN/m, taking account of ejection stability in the ink ejection head.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of disassociation.

It is desirable in the present embodiment that the colored ink liquid contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

Examples of the resin component added as the resin particles to the ink include: an acrylic resin, a vinyl acetate resin, a styrene-butadiene resin, a vinyl chloride resin, an acrylstyrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

It is desirable in the present embodiment that the ink contains a water-soluble organic solvent, from the viewpoint of preventing nozzle blockages in the ejection head due to drying. Examples of the water-soluble organic solvent include a wetting agent and a penetrating agent.

Examples of the water-soluble organic solvent in the ink are: polyhydric alcohols, polyhydric alcohol derivatives, nitrous solvents, monohydric alcohols, and sulfurous solvents.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

Moreover, it is also possible that the ink contains thermoplastic resin particles. By making the ink contain the thermoplastic resin, film formation progresses during the heating step and the image strength can be improved. If the thermoplastic resin is contained in the ink, it is more beneficial to carry out a fixing step of heating and pressing the image, in addition to the heating process during drying.

Furthermore, by making the ink contain the ultraviolet-curable monomer, it possible to improve the strength of the image by irradiating ultraviolet light onto the image in a fixing unit including an ultraviolet irradiation lamp, or the like, after the water has been evaporated off sufficiently in the drying unit, thereby curing and polymerizing the ultraviolet-curable monomer.

Treatment Liquid

It is desirable in the present embodiment that the treatment liquid (aggregating treatment liquid) has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

A treatment liquid having added thereto a polyvalent metal salt or a polyallylamine is the preferred examples of the treatment liquid. The aforementioned compounds may be used individually or in combinations of two or more thereof.

From the standpoint of aggregation ability with the ink, the treatment liquid preferably has a pH of 1 to 6, more preferably a pH of 2 to 5, and even more preferably a pH of 3 to 5.

From the standpoint of preventing the nozzles of inkjet heads from being clogged by the dried treatment liquid, it is preferred that the treatment liquid includes an organic solvent capable of dissolving water and other additives. A wetting agent and a penetrating agent are included in the organic solvent capable of dissolving water and other additives.

In order to improve fixing ability and abrasive resistance, the treatment liquid may further include a resin component. Any resin component may be employed, provided that the ejection ability from a head is not degraded when the treatment liquid is ejected by an inkjet system and also provided that the treatment liquid will have high stability in storage. Thus, water-soluble resins and resin emulsions can be freely used.

Apart from the foregoing, according to requirements, it is also possible that the treatment liquid contains a pH buffering agent, an anti-oxidation agent, an antibacterial agent, a viscosity adjusting agent, a conductive agent, an ultraviolet absorbing agent, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A printed matter seasoning apparatus, comprising:

a table on which a plurality of sheets of printed paper are placed in a stack, ink having been deposited on at least one surface of each sheet of the printed paper; and an air blowing device which blows air toward at least one of end sides of the stack on the table to supply the air simultaneously between the respective sheets in the stack, the air blowing device blowing the air at an air flow volume of at least 0.02 $m^3/(min \cdot m)$ per sheet of the printed paper and per unit length of the printed paper in a width direction thereof perpendicular to a direction from the air blowing device to the stack on the table.

2. The printed matter seasoning apparatus as defined in claim 1, wherein the air blowing device blows the air of a static pressure not lower than 500 Pa.

3. The printed matter seasoning apparatus as defined in claim 1, wherein the air blowing device blows the air of same temperature and humidity as surrounding environment.

4. The printed matter seasoning apparatus as defined in claim 1, wherein the air blowing device has air flow volume-static pressure characteristics which encompass a point representing a required air flow volume $Q=M \times Wp \times 0.02\ m^3/min$ and a required static pressure P=500 Pa, where M is a maximum number of processed sheets which the printed matter seasoning apparatus is capable of simultaneously processing, and Wp is a length, having unit of meter, of one side of the printed paper in the width direction thereof.

5. The printed matter seasoning apparatus as defined in claim 1, further comprising a ceiling plate member which is arranged over the table.

6. The printed matter seasoning apparatus as defined in claim 5, wherein:

a paper accommodating section is defined between the table and the ceiling plate member; and the air blowing device has an air blowing port of a size covering a whole region of the paper accommodating section in a height direction thereof.

7. The printed matter seasoning apparatus as defined in claim 5, wherein the ceiling plate member is configured to move upward as the sheets of the printed paper float upward due to the air blown from the air blowing device.

8. The printed matter seasoning apparatus as defined in claim 1, wherein:

the air blowing device blows the air from one of perimeter planes which are along the end sides of the stack on the table;

an air passage port is arranged in another of the perimeter planes; and the air supplied between the sheets in the stack from the air blowing device escapes through the air passage port to exterior.

9. The printed matter seasoning apparatus as defined in claim 1, wherein the air blowing device blows the air in at least two directions toward at least two of the end sides of the stack on the table.

10. The printed matter seasoning apparatus as defined in claim 1, further comprising a side plate member which covers a portion of perimeter of the stack on the table in order to prevent leakage of the air blown from the air blowing device.

11. The printed matter seasoning apparatus as defined in claim 1, further comprising at least one shelf plate member with which the sheets of the printed paper are placed dividedly in a plurality of stacks.

12. The printed matter seasoning apparatus as defined in claim 1, wherein the ink contains water as a solvent.

13. The printed matter seasoning apparatus as defined in claim 12, wherein the ink contains thermoplastic resin and coloring material.

14. The printed matter seasoning apparatus as defined in claim 12, wherein the ink contains active light-curable resin and coloring material.

15. An inkjet recording apparatus, comprising a paper output section which includes the printed matter seasoning apparatus as defined in claim 1.

16. A method of seasoning printed matter, comprising the steps of:

placing a plurality of sheets of printed paper in a stack on a table, ink having been deposited on at least one surface of each sheet of the printed paper; and blowing air by an air blowing device toward at least one of end sides of the stack on the table to supply the air simultaneously between the respective sheets in the stack, the air being blown by the air blowing device at an air flow volume of at least 0.02 $m^3/(min \cdot m)$ per sheet of the printed paper and per unit length of the printed paper in a width direction thereof perpendicular to a direction from the air blowing device to the stack on the table.

17. The method of seasoning printed matter as defined in claim 16, wherein in the blowing step, the air blowing device blows the air of a static pressure not lower than 500 Pa.

18. The method of seasoning printed matter as defined in claim 16, wherein in the blowing step, the air blowing device blows the air of same temperature and humidity as surrounding environment.

* * * * *